United States Patent [19]

Robbins

[11] Patent Number: 4,912,782

[45] Date of Patent: Apr. 3, 1990

[54] FLUID SPOUT PROVIDING LAMELLIFORM OUTFLOW

[75] Inventor: Tom E. Robbins, San Leandro, Calif.

[73] Assignee: Kallista, Inc., San Leandro, Calif.

[21] Appl. No.: 258,670

[22] Filed: Oct. 17, 1988

Related U.S. Application Data

[63] Continuation-in-part of Ser. No. 54,230, May 26, 1987, abandoned.

[51] Int. Cl.[4] ..... E03C 1/04

[52] U.S. Cl. ..... 4/192; 4/569; 239/520; 239/523; 239/565

[58] Field of Search ..... 4/191, 192, 569, 619; D23/255-257; 137/801; 239/396, 520, 523, 521, 565, 590

[56] References Cited

U.S. PATENT DOCUMENTS

| | | | |
|---|---|---|---|
| D. 268,949 | 5/1983 | Delephine | D23/32 |
| 372,347 | 11/1887 | Wells | 4/569 |
| 1,207,790 | 12/1916 | Peterson | 239/565 |
| 1,499,202 | 6/1924 | Coutu | 239/565 X |
| 1,536,230 | 5/1925 | McCue | 239/520 |
| 3,144,211 | 8/1964 | Goldman | 239/532 X |
| 3,672,576 | 6/1972 | Jefferson et al. | 239/521 |
| 4,334,328 | 6/1982 | Delephine | 4/191 |
| 4,376,511 | 3/1983 | Franklin | 239/520 X |
| 4,513,458 | 4/1985 | Delepine | 4/661 X |

FOREIGN PATENT DOCUMENTS

| | | | |
|---|---|---|---|
| 58607 | 5/1968 | Belgium | 4/615 |

*Primary Examiner*—Charles E. Phillips
*Attorney, Agent, or Firm*—Harris Zimmerman

[57] ABSTRACT

A spout fixture for bathtubs, wash basins or the like has a body with a thin horizontal water emission zone from which a sheet-like flow of water is directed along the underside of a flow guide to a discharge zone at the end of the flow guide. The flow guide undersurface curves downwardly as the discharge zone is approached enabling momentum and adhesion to hold the flow on the downwardly facing surface against the pull of gravity. Water released from the end of the flow guide travels downwardly into the receptacle in the form of a free falling, thin, smooth curtain of water that minimizes noise and splashing and is attractive in appearance.

13 Claims, 3 Drawing Sheets

FLUID SPOUT PROVIDING LAMELLIFORM OUTFLOW

CROSS REFERENCE TO RELATED APPLICATION

This application is a continuation-in-part of applicant's similarly entitled copending U.S. patent application Ser. No. 07/054,230 which was filed May 26, 1987 now abandoned.

TECHNICAL FIELD

This invention relates to plumbing fixtures and more particularly to spout fixtures through which water is released into bathtubs or other receptacles.

BACKGROUND OF THE INVENTION

Most prior water spouts of the type used at bathtubs, wash basins or the like have a more or less circular cross section which releases the water flow in the form of a column which, at least initially, has a similar cross section. The impact of the concentrated flow on the bathtub or the like or on water already contained in the tub produces an undesirable amount of noise and splashing.

These effects can be mitigated to some extent by aeration attachments which entrain air bubbles in the flow but such devices reduce water flow rate and are prone to clogging.

The columnar outflow of water from the typical bathtub water spout is also not particularly pleasing from the esthetic standpoint.

Prior U.S. Pat. No. 4,334,328, issued June 15, 1982, and the related U.S. Pat. No. Des. 268,949, issued May 10, 1983, disclose a water spout which is less subject to the problems discussed above as water is released from the spout in the form of a long thin curtain. Impact effects are not concentrated at a single small area of the tub or its contents as in the more conventional construction.

In the prior construction identified above, the water flow is wholly confined within a flattened nozzle until it is released from the spout through a thin slot outlet and the flow path to the outlet is defined by two very closely spaced parallel internal walls. Consequently, minor amounts of deposition of solids on the internal walls, such as often occurs within water conduits, can easily disrupt the uniformity of the sheet-like water outflow. Cleaning of such deposits from within the spout is difficult at best. The width of the curtain like outflow is also noticeably variable as it is dependent on flow rate.

Prior U.S. Pat. No. 4,513,458, issued Apr. 30, 1985, describes a spout which also dispenses water in a sheet-like flow and which can be cleaned more easily as the flow guiding surface is exposed. In this case the flow travels along the upper surface of a curved shelf along a flow path which becomes increasingly more horizontal towards the end where the sheet-like flow is released into the receptacle. The construction requires that flow rate be limited if the water curtain is to impact at a predetermined fixed region of the receptacle as increases in flow rate above a certain level cause the water to shoot outward and impact at increasingly greater distances from the spout. This can be discomforting to users, particularly if the water is extremely hot or cold.

Prior U.S. Pat. No. 372,347, issued Nov. 1, 1887, describes a bathtub having built-in shower spray apertures which extend along the walls of the tub. Pivotable water gathering hoods can be shifted to intercept the spray to cause the flow to travel down the walls of the bathtub at times when the user does not desire the shower like inflow or when it is desired to clean the bathtub. An inflow which travels along the inside wall of the receptacle is not particularly attractive and can be discomforting under some circumstances. Users of wash basins in public restrooms, for example, often avoid touching water which has contacted the walls or collected in the basin as the walls may be unclean.

Ideally, a water spout of the type which delivers a thin curtain of water should be easily cleanable and should deposit the inflow at a predetermined region which does not change substantially when flow rate is varied. The flow should remain broad and continuous when flow rates through the spout are reduced to low levels and its is desirable that the inflow fall freely into the receptacle rather than scouring along an interior wall. The prior art does not provide a construction which combines these attributes.

The present invention is directed to overcoming one or more of the problems discussed above.

SUMMARY OF THE INVENTION

In one aspect, the present invention provides a spout for releasing fluid from a supply conduit into a receptacle in the form of a thin curtain of fluid which drops in a free fall from a discharge zone that is spaced away from the walls of the receptacle. The spout has a body with an internal chamber, means for communicating the chamber with the supply conduit and outlet means for emitting fluid from the chamber along a thin linear emission zone to cause the outflow from the emission zone to have a thin sheet-like configuration, the emission zone being spaced apart from the discharge zone. Support means are included for securing the spout in place at the receptacle with the emission zone being held in a horizontal orientation. An outflow guide extends from the body to the discharge zone and has a concave flow guiding surface with a first portion that is adjacent and parallel to the emission zone and positioned to cause the outflow to travel along the flow guiding surface to the discharge zone. The flow guiding surface has a downwardly facing distal portion along which the sheet-like outflow approaches the discharge without underlying support of the outflow. The distal portion of the flow guiding surface is curved to become more vertical at it approaches the discharge zone whereby momentum holds the outflow against the downwardly facing surface.

In another aspect, the invention provides a water spout for releasing water from a water supply into a bathtub or the like in the form of a thin sheet of water which drops from a linear discharge zone that is spaced apart from the walls of the bathtub or the like. The spout includes a tubular body with an axially extending water receiving chamber and outlet means for releasing water from the chamber along a thin linear emission zone which is spaced apart from and parallel to the discharge zone. Support means are present for securing the body in place at the bathtub or the like with the emission zone being held in a horizontal orientation and means are provided for communicating the water supply conduit with the chamber. An outflow guide member extends outward from the body and has a concave flow guiding surface shaped to define a curving flow path from the emission zone to the discharge zone, the surface having an inner region which is adjacent to and parallel to the emission zone and oriented to receive the outflow from the emission zone. The flow guiding surface further has a distal portion which faces downwardly and along which the outflow travels without underlying support of the outflow. The distal portion of the flow guiding surface has a progressively greater downward curvature as it approaches the discharge zone, the downward curvature being sufficient to cause the outflow to remain against the downwardly facing surface as it travels along the surface.

In another aspect of the invention, a fluid spout for directing fluid from a supply conduit into the interior of a receptacle in the form of a free falling thin curtain of fluid includes a body with an internal chamber and a thin linear fluid emission zone in a wall of the chamber. Support means are provided for securing the body including the emission zone above a wall of the receptacle with the emission zone being in a horizontal orientation. An outflow guide has a downwardly facing flow guiding surface oriented to direct the outflow from the emission zone out over the interior of the receptacle, the surface having sufficient downward curvature to retain an unsupported flow of high velocity fluid against the surface. The outflow guide also has an upwardly facing surface for intercepting low velocity fluid that may fall from the flow guiding surface and which is situated below the flow guiding surface in spaced apart relationship from the flow guiding surface and is oriented to deliver intercepted fluid into the interior of the receptacle.

In still another aspect, the invention provides a fluid releasing spout for connection with a fluid supply conduit, the spout having a body with an internal chamber and means for communicating the chamber with the supply conduit. The body further has outlet means for emitting fluid along a thin, linear horizontally oriented zone to cause the outflow from the body to have a thin sheet-like configuration. An outflow guide member extends outward from the body and has a curved undersurface which extends along the fluid emitting zone, the undersurface having an inner portion positioned to intercept the outflow of fluid from the zone and having an outer portion which curves downwardly to deflect the fluid outflow into a downwardly directed thin curtain of released fluid. The body is tubular and the fluid emitting zone extends along the wall of the body in parallel relationship to the axis of the body. The guide member has a pair of attachment rings positioned to be at opposite ends of the body in coaxial relationship with the body when the guide member is joined to the body. Each of a pair of removable spools is disposed within an opposite end of the body and form end closures for the body. Each of the spools has a threaded axial passage. The spout further includes a pair of threaded fasteners each being at an opposite end of the body and extending through the one of the attachment rings which is at the same end of the body, the fasteners being engaged in the threaded axial passages of the spools.

In the present invention, one or more spray apertures in the body of the spout direct a sheet-like fluid flow along an exposed flow guiding surface at least the distal portion of which faces downwardly. The downwardly facing surface curves downwardly along the flow path enabling momentum and adhesion to retain the sheet-like flow against the surface in opposition to the pull of gravity. The flow is released from the end edge of the guiding surface in the form of a downwardly directed thin, smooth curtain or fluid which drops into the receptacle with a minimum of noise and splashing and at a location spaced away from the walls of the receptacle. The discharged curtain of fluid remains desirably broad and continuous at anything other than minimal flow rates. The exposed fluid guiding surface can be easily cleaned to remove any deposits which might otherwise disrupt the uniformity of the discharge curtain. The attractive curtain-like discharge impacts the interior of the receptacle at a particular location that does not vary substantially when flow rate is changed.

DETAILED DESCRIPTION OF THE PREFERRED EMBODIMENTS

Figure 1:
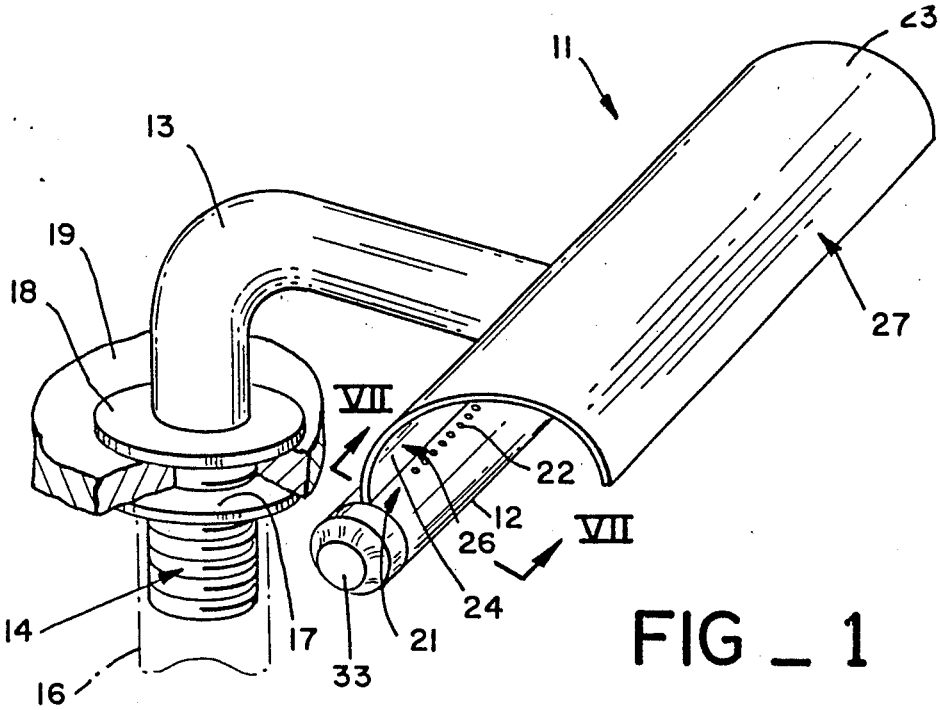
FIG. 1 is a perspective view of a water spout for a bathtub or the like in accordance with a first embodiment of the invention.

Referring initially to FIG. 1 of the drawings, components of a spout fixture 11 in accordance with this embodiment of the invention include a tubular body 12 which has a horizontal orientation when the spout is installed on a bathtub, wash basin or the like. An angled inlet tubulation 13 extends backward from the central region of body 12 and then downward and is provided with external threads 14 for engagement with an internally threaded upright water supply pipe 16. A threaded annular fitting 17 is engaged on threads 14 and cooperates with a fixed flange 18 situated above threads 14 to clamp the spout 11 to a portion 19 of the bathtub or the like into which the tubulation extends.

The water supply pipe 16 is, in most cases at least, the outlet conduit of one or more valves (not shown) which may be of conventional construction and with which the flow of water may be turned on and off. The above described inlet tubulation 13 configuration of this particular embodiment is designed for use at an installation where the water supply conduit 16 is vertical and extends upward to the rim of the tub 19 typically at the front of the tub. The configuration of the inlet tubulation 13 including threads 14, fitting 17 and flange 18 may be varied as necessary to accomodate to the water delivery arrangements of other types of bathtub fixture or the like. Two inlet tubulations 13 may be provided, for example, at installations where hot and cold water are delivered through separate conduits 16.

Water is emitted from the body 12 along a thin linear horizontal emission zone 21 which extends in parallel relationship with the axis of the tubular body and which in this example is defined by a row of closely spaced apart small apertures 22 through the wall of the body. The water emission zone 21 is near the top of body 11 in this embodiment causing the water outflow to be directed upward and slightly forward. The zone 21 may in some cases be at a lower location on body 12 and may direct the outflow in other directions as the flow is guided to the discharge zone along a non-linear flow path as will hereinafter be described in more detail.

A curved outflow guide member 23 is secured to body 12 and has an undersurface 24 which is parallel to the water emission zone 21 and which has a inner end portion 26 that is adjacent the zone in position to be receive the water which sprays out through apertures 22. Inner end portion 26 of guide member 23 extends upwardly from body 12 and progressively becomes more horizontal. The distal or outer portion 27 of the guide member 23 progressively curves into an almost downward orientation.

The inner and portion 26 of guide member 23 is oriented to cause the sheet-like outflow from apertures 22 to be directed along the inside surface of the guide member, the plane of the outflow preferably being directed in a tangential relationship or close to a tangential relationship with the region of the guide surface that receives the outflow. Turbulence and rebounding of the flow occurs if the outflow impacts against the guide member 23 at a substantial angle and the discharge of fluid from the spout 11 does not have the desired thin continuous sheet-like form if such effects occur to an appreciable extent.

Figure 3:
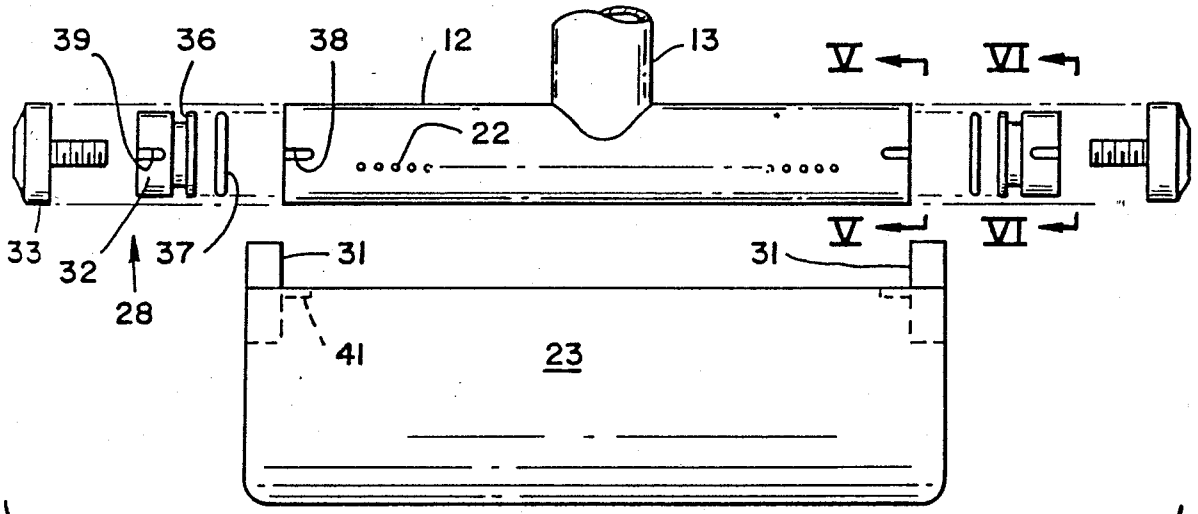
FIG. 3 is an exploded top view of a portion of the water spout of the preceding figures showing components in a disassembled condition.
Figure 2:
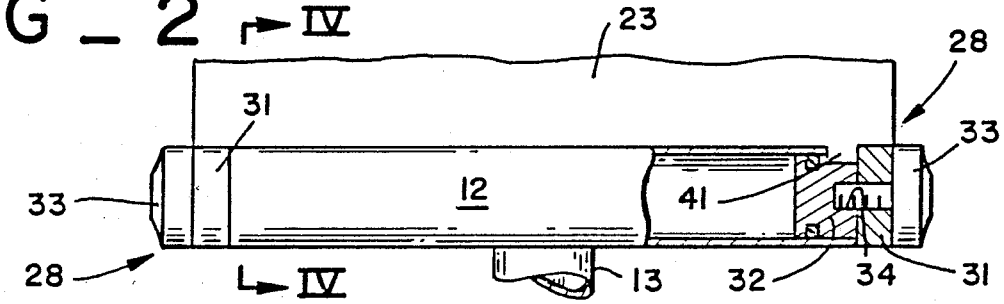
FIG. 2 is a front elevation view of a portion of the water spout of FIG. 1.

Referring jointly to FIGS. 2 and 3, the guide member 23 is preferably disengageable from body 12 to facilitate cleaning. For similar reasons, it is desirable that one and preferably both end closures 28 of the internal chamber 29 of body 12 be removable. To accomplish these objectives in the present embodiment, the guide member 23 attaches to body 12 through a pair of rings 31 each of which is secured to an opposite end of the guide member in position to be in coaxial relationship with the tubular body when the guide member is fitted on to the body. One of a pair of cylindrical spools 32 fits into each end of body 12 and one of a pair of cap screw like components 33 at each end extends through the adjacent ring 31 of guide member 23 and engages in a threaded passage 34 in the adjacent spool 32.

Each spool 32 preferably has an annular groove 36 in which a resilient O-ring seal 37 is seated to assure against leakage.

Figure 5:
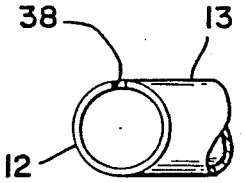
FIG. 5 is an end view of a component of the water spout of FIG. 3 taken along line V—V thereof.
Figure 6:
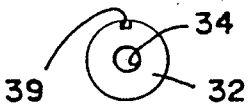
FIG. 6 is an end view of another component of the water spout of FIG. 3 taken along line VI—VI thereof.
Figure 4:
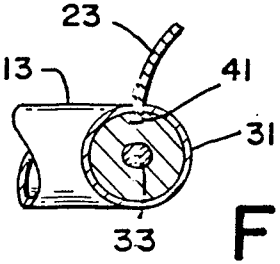
FIG. 4 is a cross section view of the apparatus of FIG. 2 taken alone line IV—IV thereof.

Referring to FIGS. 3 and 5 in conjunction, a short axially aligned guide slot 38 is present at each end of the tubular body 12 at the locations where the inner edge of guide member 23 contacts the body and as may be seen by reference to FIG. 6 a matching slot 39 is provided in each spool 32. Referring to FIGS. 2 and 4 in conjunction, tang projections 41 on guide member 23 adjacent each ring 31 enter the slots 38 and 39 when the apparatus is assembled to assure that the guide member 23 is at the correct angular orientation relative to body 12 and to prevent rotation of the spools 32 when the cap screw like elements 33 are being engaged and disengaged.

Figure 8:
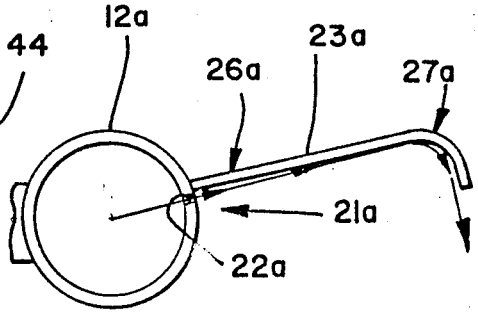
FIG. 8 is a cross section view corresponding generally to FIG. 7 but illustrating the modified construction of a second embodiment of the invention.

The curvature of the guide member 23 of the above described embodiment of the invention is substantially circular although the member extends around slightly less than one half of a circular arc in this example. The guide member 32 may have other concave configurations. Referring to FIG. 8, for example, the water emitting apertures **22*a* may be situated at a somewhat lower position on body 12*a* in order to direct water jets in a more horizontal and less upward direction. The guide member 23*a* may then have an inner portion 26 which is flat for a short distance and substantially parallel with the water jets and may have an outer portion 27*a*** which is more sharply curved in a downward direction than that of the previously described embodiment.

Figure 9:
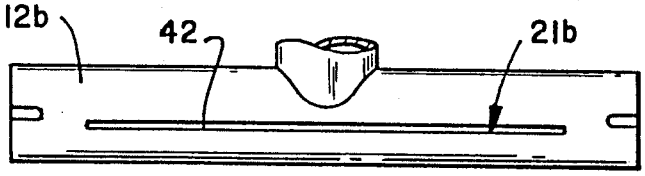
FIG. 9 is a top view of a portion of another embodiment having a modified water outlet aperture.
Figure 10:
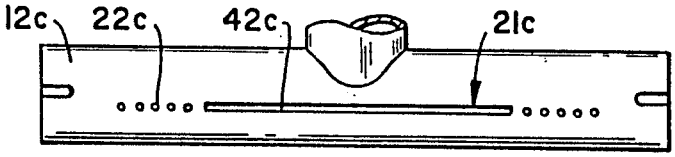
FIG. 10 is a top view of a portion of still another embodiment having another modified water outlet configuration.

The water emission zones 21, **21*a* of the previously described embodiments of the invention are defined by a row of small spaced apart apertures 22, 23*a*. Referring now to FIG. 9, the water emission zone 21b may also be defined by a single thin continuous slot 42 which extends along the side of the body 12*b*. Referring to FIG. 10, the water emission zone 21*c* may also be a combination of apertures 22*c* and one or more slots 42*c***, the central portion of the zone being defined by a slot in this example and the end portions of the zone being defined by rows of apertures.

Figure 7:
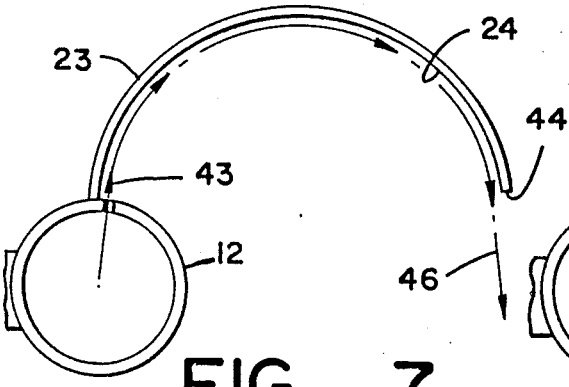
FIG. 7 is a cross section view taken along VII—VII of FIG. 1 illustrating the path and configuration of water outflow.

In operation, with reference to FIGS. 1 and 7, the linear configuration of the water emission zone 21 causes water to be emitted from body 12 in a lamelliform or sheet-like spray 43 which travels along the curved undersurface 24 of guide member 23 and which is deflected first outwardly and then downwardly by the guide member. Momentum assisted by adhesion holds the water flow against undersurface 24 as the rapidly moving water flow resists deflection.

Upon reaching the outer edge 44 of guide member 23, which forms the flow discharge zone, the flow is released from the spout 11 in the form of a continuous thin sheet or curtain of water 46 which is directed downward and slightly outward in this example. Noise and splashing the substantially reduced relative to a columnar discharge of water.

Calcifications or other deposits which might appear on the undersurface 24 and which might cause nonuniformities in the water curtail 46 can easily be removed as it is an accessible external surface. The interior of body 12 may be easily cleaned and any clogging substances may be removed by disengaging end members 33 and withdrawing spools 32 in the manner hereinbefore described.

Referring again to FIG. 7, the outflow of water from emission zone 21 tends to spread laterally as it travels along the under surface 24 of guide member 23. Premature release of water from the sides of the member 23 can be prevented by limiting the length of the water emission zone 21 to less than the full width of the guide member 23 to allow for such spreading.

Referring again to FIG. 1, water emitted from the apertures 22 at a very low setting of the associated control valve may not have sufficient momentum to travel along the full length of the undersurface 24 of guide member 23. This condition may also exist momentarily while the water flow is being turned on or shut off. Leaking of the control valve at its off setting can also cause a release of low velocity water that will not travel along the guide member 23. This does not cause any spillage problem in the above described embodiments of the invention as the angled inlet tubulation 13 is of sufficient length to hold the body 12 and guide member 23 out over the interior of the bathtub or the like. Dripping water or low velocity water simply falls into the interior of the bathtub.

Figure 11:
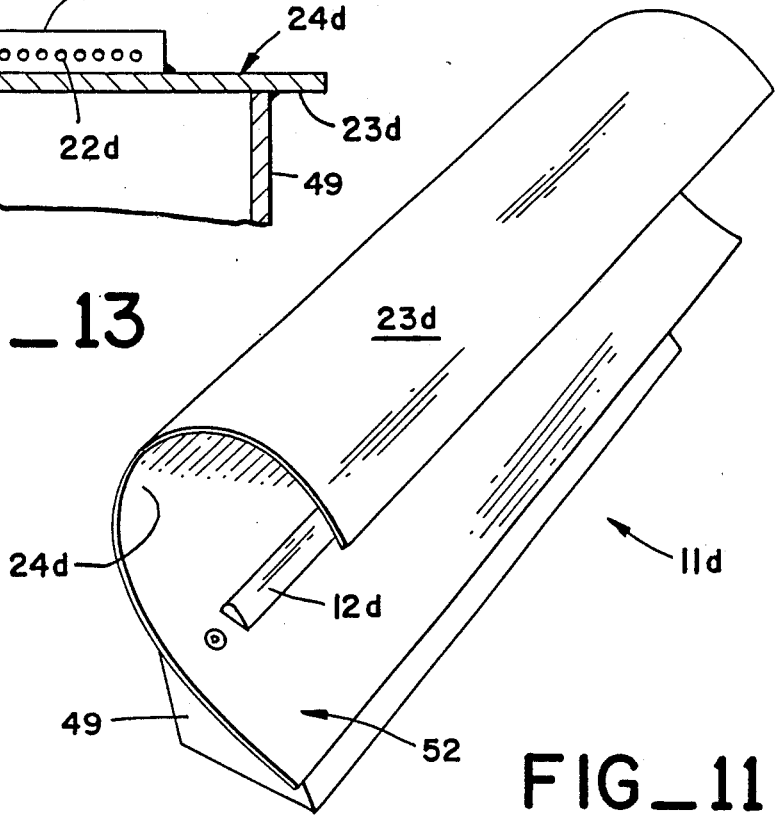
FIG. 11 is a perspective view of a further embodiment of the invention.
Figure 12:
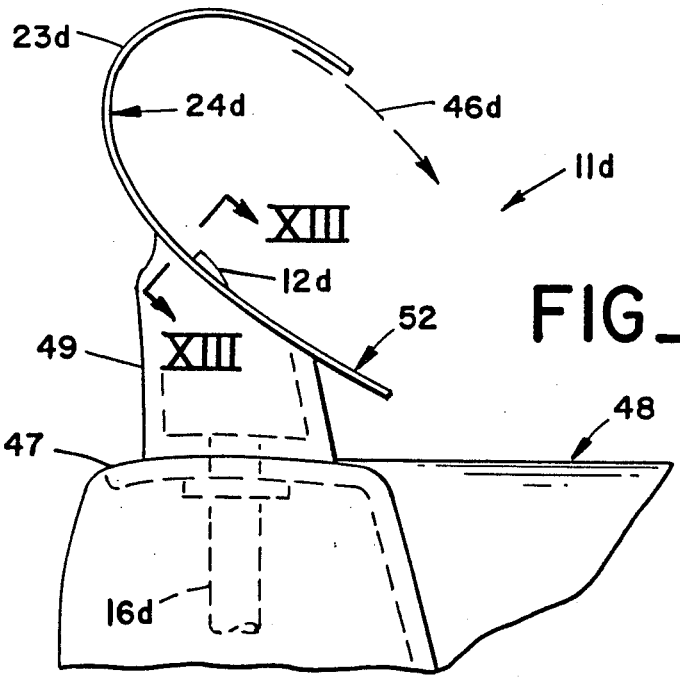
FIG. 12 is a side view of the embodiment of FIG. 11 shown mounted at the head of bathtub.

Referring now to FIGS. 11 and 12 in conjunction, it may be advantageous under some circumstances to mount the spout fixture 11*d* directly over the headwall 47 of the bathtub 48 of the like so that it does not protrude over the interior of the bathtub. The embodiment of FIGS. 11 and 12 has a modified construction which assures that drippage and low velocity water is deposited within the bathtub 48 rather than on the rim of the headwall 47 or outside the bathtub.

Figure 13:
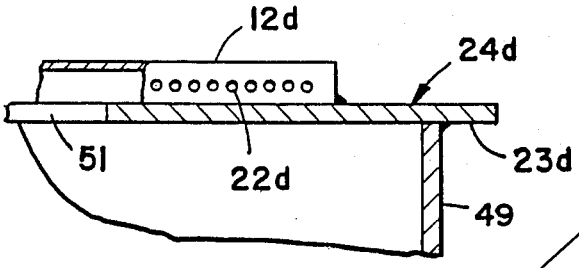
FIG. 13 is a section view of a portion of the embodiment of FIG. 12 taken along line XIII—XIII thereof.

Referring to FIGS. 12 and 13, the outflow guide member 23*d* of this embodiment is supported by a hollow reservoir pedestal 49 to which it is secured and which is itself secured to the top surface of the bathtub headwall 47. The water supply pipe 16d extends upward though an opening in headwall 47 to communicate with the interior of the reservoir pedestal 49. The water emitting tubular body 12*d* extends transversely on the outflow guide member 23*d* within the concavity defined by the guide member and receives water from the reservoir pedestal 49 through a slot 51 in the guide member. Body 12*d*, which has a somewhat flattened configuration in this embodiment for esthetic reasons, has a row of water emitting apertures 22*d*, oriented to direct a flat thin sheet of water onto the inner surface 24*d* of the guide member 23*d* in the manner previously described.

Apertures 22*d* are located at the back of the body 12*d* from the viewpoint of a person using the bathtub 48. The inner surface 24*d* of the guide member 23*d* extends backward and upward from the region of apertures 22*d* and progressively curves more upwardly and then turns downwardly to form a curved flow path which reverses the direction of the sheet-like flow of water and which directs the flow out into the interior of the bathtub 48 in the form of an arcuate thin curtain 46*d* which produces minimal noise and splashing and which is attractive in appearance.

Low velocity water that locks sufficient momentum to be held on guide surface 24*d* against the pull of gravity and any drippage which may occur are caught and delivered to the interior of the bathtub 48 by an apron like lower portion 52 of guide member 23*d*. The lower portion 52 extends forward and downward from the region of the tubular body 12*d* to a location where water which travels down the extension will be released into the bathtub 48. The upper surface 53 of the apron portion 52 is preferably a smooth integral extension of the inner surface 24*d* of other portions of the concave outflow guide member 23*d*.

While the invention has been described with respect to certain particular embodiments for purpose of example, numerous other modifications of the structure are possible and it is not intended to limit the invention except as defined in the following claims.

I claim:

1. A fluid spout for releasing fluid from a supply conduit into a receptacle in the form of a thin curtain of fluid which drops in a free fall from a discharge zone that is spaced away from the walls of said receptacle, said spout having a body with an internal chamber and means for communicating said chamber with said supply conduit and having outlet means for emitting fluid from said chamber along a thin linear emission zone extending longitudinally of said body to cause the outflow from said emission zone to have a thin sheet-like configuration, said emission zone being spaced apart from said discharge zone, and further having support means for securing said spout in place at said receptacle with said emission zone being held in a horizontal orientation, wherein the improvement comprises:

an outflow guide extending from said body to said discharge zone, said guide having a concave flow guiding surface with a first portion that is adjacent said emission zone and parallel thereto and which is positioned to substantially tangentially intercept said thin sheet-like outflow therefrom to cause said outflow to travel along said flow guiding surface to said discharge zone, said surface having a downwardly facing distal portion along which said thin sheet-like outflow approaches said discharge zone without underlying support of said outflow, at least said downwardly facing distal portion of said surface being curved to become more vertical as it approaches said discharge zone whereby momentum holds said outflow against said downwardly facing distal portion of said flow guiding surface.

2. The spout of claim 1 wherein the plane defined by said thin sheet-like outflow from said outlet means is substantially tangential to said concave flow guiding surface.

3. The spout of claim 1 wherein said outlet means includes a plurality of apertures in said body which are spaced apart along said linear fluid emission zone thereof and which all lie in a single line extending longitudinally of the body.

4. The spout of claim 1 wherein said outlet means includes a thin slot extending longitudinally of said body along at least a portion of said fluid emission zone.

5. The spout of claim 1 wherein said outflow guide extends further along said body than said fluid emission zone at each end of said emission zone whereby said outflow remains in contact with with said flow guiding surfaces as it spreads while traveling therealong.

6. The spout of claim 1 wherein said outlet means is positioned on said body to direct emitted fluid in an upward direction and wherein said first portion of said outflow guide extends upwardly from said body and progressively becomes more horizontal, and wherein said distal portion of said outflow guide progressively becomes more downwardly directed as it approaches said discharge zone, said first portion and said second portion being substantially parallel to each other.

7. The spout of claim 1 wherein said support means is adapted to locate said body including said fluid emission zone above the rim of said receptacle and said outflow guide is oriented to project said thin sheet-like outflow out into the interior of said receptacle, further including means for intercepting low velocity fluid which falls from said downwardly facing portion of said flow guiding surface and for delivering the intercepted fluid to said interior of said receptacle.

8. The spout of claim 7 wherein said means for intercepting low velocity fluid includes an apron like shelf extending from said body below said distal portion of said flow guiding surface in spaced apart relationship therewith.

9. The spout of claim 1 wherein said body including said fluid emission zone is oriented to direct said outflow therefrom away from said discharge zone and said concave flow guiding surface of said outflow guide is shaped to turn the outflow towards said discharge zone along a flow path which first curves increasingly upward and then curves downwardly as it approaches said discharge zone, and wherein said outflow guide has a lower extension of said concave surface that extends under said distal portion thereof in spaced apart relationship therefrom to intercept falling fluid which lacks sufficient momentum to travel along said downwardly facing distal portion of said surface, said extension being sloped to deliver intercepted fluid into the interior of said receptacle.

10. A water spout for releasing water from a water supply conduit into a bathtub or the like in the form of a thin sheet of water which drops from a linear discharge zone that is spaced apart from the walls of the bathtub or the like, comprising:

a tubular body with a water receiving chamber extending axially therein, said body having outlet means for releasing water from said chamber along a thin linear emission zone which extends longitudinally along the wall of said body, said emission zone being spaced apart from said discharge zone and being parallel thereto, support means for securing said body in place at said bathtub or the like with said emission zone being held in a horizontal orientation, means for communicating said water supply conduit with said chamber, and an outflow guide member secured to said body and extending outward therefrom and inwardly of said bathtub, said guide member having a concave flow guiding surface shaped to define a curving flow path from said emission zone to said discharge zone, said surface having an inner region which is adjacent said emission zone and parallel thereto and oriented to tangentially receive the outflow therefrom and having a distal portion which faces downwardly and along which said outflow travels without underlying support of said outflow, said distal portion of said surface having progressive greater downward curvature as it approaches said discharge zone, said downward curvature being sufficient to cause said outflow to remain against said downwardly facing surface as it travels therealong.

11. A fluid spout for directing fluid from a supply conduit into the interior of a receptacle in the form of a free falling thin curtain of fluid, comprising:

a body having an internal chamber and a thin linear fluid emission zone in a wall thereof, means for communicating said supply conduit with said internal chamber of said body, support means for securing said body including said emission zone above a wall of said receptacle with said emission zone being in a horizontal orientation, and an outflow guide having a downwardly facing flow guiding surface oriented to direct the outflow from said emission zone out over the interior of said receptacle, said downwardly facing surface having sufficient downward curvature to retain an unsupported high velocity flow of fluid thereagainst, said outflow guide further having an upwardly facing surface for intercepting low velocity fluid that may fall from said flow guiding surface and which is situated below said flow guiding surface in spaced apart relationship therefrom and which is oriented to deliver intercepted fluid into said interior of said receptacle.

12. In a fluid releasing spout for connection with a fluid supply conduit, said spout having a body with an internal chamber and means for communicating said chamber with said fluid supply conduit and further having outlet means for emitting fluid from said chamber along a thin linear horizontally oriented zone on said body to cause the outflow from said body to have a thin sheet-like configuration, the improvement comprising:

an outflow guide member secured to said body and extending outward therefrom, said guide member having a curved undersurface which extends along said zone, said undersurface having an inner portion positioned to intercept the outflow of fluid from said zone and having an outer portion which curves downwardly to deflect said fluid outflow into a downwardly directed thin curtain of released fluid, wherein said body is tubular and said fluid emitting zone extends along the wall thereof in parallel relationship to the axis of said tubular body and wherein said guide member has a pair of attachment rings positioned to be at opposite ends of said tubular body in coaxial relationship therewith when said guide member is joined to said body, further including a pair of removable spools, each being disposed within an opposite end of said tubular body and forming an end closure thereof, each of said spools having a threaded axial passage, and a pair of threaded fasteners each being at an opposite end of said body and extending through the one of said attachment rings thereat and being engaged in the threaded axial passage of the one of said spools thereat.

13. The spout of claim 12 wherein each end of said tubular body and each of said spools has a slot entering the periphery thereof, and wherein said guide member has tang projections extending into said slots of said body and said spools at each end of said body.

* * * * *